United States Patent [19]

Sittardt et al.

[11] 4,024,084

[45] May 17, 1977

[54] DISPERSION FOR APPLYING SOLID PARTICLES ON SURFACES BY AN ELECTROPHOTOGRAPHIC PROCESS

[75] Inventors: Hans Günter Sittardt; Siegfried Stotz, both of Aachen, Germany; Dirk Jan Zwanenburg; Wilhelmus Adrianus Petrus Reijnen, both of Eindhoven, Netherlands

[73] Assignee: U.S. Philips Corporation, New York, N.Y.

[22] Filed: Dec. 15, 1975

[21] Appl. No.: 640,446

[30] Foreign Application Priority Data

Dec. 21, 1974 Germany ..... 2460763

[52] U.S. Cl. ..... 252/62.1 L; 252/62.1 R; 260/438.5 R; 260/448 R

[51] Int. Cl.² ..... G03G 9/12

[58] Field of Search ..... 252/62.1 R, 62.1 L; 260/438.5 R, 448 R

[56] References Cited

UNITED STATES PATENTS

| | | | |
|---|---|---|---|
| 3,417,019 | 12/1968 | Beyer | 427/145 |
| 3,475,169 | 10/1969 | Lange | 96/1 R |
| 3,900,412 | 8/1975 | Kosel | 252/62.1 L |
| 3,900,413 | 8/1975 | Metcalfe et al. | 252/62.1 L |

*Primary Examiner*—Mayer Weinblatt
*Assistant Examiner*—John D. Smith
*Attorney, Agent, or Firm*—Frank R. Trifari; Norman N. Spain

[57] ABSTRACT

The composition of liquid toners and hence the recycling of such toners is simplified when, as the only substance controlling the charge of the pigments and luminescent substances, respectively, an aluminium (III) salt or a chromium (III) salt of an anthranilic acid possibly substituted at the benzene nucleus is used and the amino group of which is acylated with a fatty acid containing 6 to 20 carbon atoms.

9 Claims, No Drawings

DISPERSION FOR APPLYING SOLID PARTICLES ON SURFACES BY AN ELECTROPHOTOGRAPHIC PROCESS

The invention relates to a dispersion for electrophotographically providing solid particles on surfaces, which dispersion contains, in addition to the solid particles, a non-polar dispersion agent, a non-iogenic, macromolecular compound which is soluble in the dispersion agent, and a substance which controls the charge of the solid particles.

Such dispersions are used as liquid developers or liquid toners in electrographic reproduction methods, in which a selective deposition of the dispersed particles on a substrate takes place. For example, visible pictures or patterns may be provided on a foil, for example of paper. The most important field of application of such dispersions is the electrophotographic reproduction by means of duplicating machines.

It is furthermore known to cover display screens of colour television display tubes with luminescent materials by an electrophotographic method (U.S. Pat. No. 3,475,169). For that purpose the inside of the display screen is provided with a conductive layer and a photoconductive organic layer is applied on the conductive layer. The photoconductive layer is charged by means of a corona discharge, is discharged via a grating or mask according to a picture pattern, and is then developed with a dispersion containing solid particles of a luminescent material. For that purpose, the luminescent materials should have an electric charge. Under the influence of an electric field, said charge produces a transport towards the screen. Dependent on the polarity of the corona charge and the charge of the luminescent materials, the particles deposit either in the relatively charged or uncharged places. The conductive layer and the photoconductive layer are finally removed by heating, the luminescent layers simultaneously sintering together.

The published German Patent Applications 1,928,817 and 1,966,674 disclose a dispersion of the kind mentioned in the preamble which may be used for general electrophotographic purposes as well as for coating luminescent screens of colour television display tubes with luminescent material in which the non-polar dispersion agent has an intrinsic conductivity of less than $10^{-14}$ $ohm^{-1}cm^{-1}$. As substances controlling the charge of the solid particles are mentioned in the published German Patent Application 2,114,773 inter alia chromium salts of 3,5-dialkylsalicylic acids in which the alkyl group may contain up to 18 carbon atoms and chromium salts of the dialkyl-g-resorcinic acid having the same alkyl groups. As useful chromium compounds for this purpose use may also be made of the chromium soaps of linoleates, naphtenates, resinates, palmitates, stearates, and the like according to the published German Patent Application 1,930,783 and the stearylato chromium chloride ("Quilon S") according to U.S. Pat. No. 3,417,019.

In practice, the liquid toner system always consist of a large number of components. The published German Patent Application 2,114,773 deals with the problem that the various constituents of a liquid toner system are consumed at different rates. The larger the number of components present in the system, the more difficult is the problem of the preferential depletion and corresponding refreshment. In practice it is not simple to replenish the various components in the various quantities and at the various rates at which they are consumed. According to the published German Patent Application 2,114,773 a solution to this problem consists in that the dispersion comprises an amphipathic substance defined in greater detail in said Patent Application and comprising solvated and non-solvated groupings in the system of solvents.

It is to be noted that the above-mentioned chromium salts stated in the published German Patent Application 2,114,773 are not considered among these amphipathic substances but among the conventionally used substances for influencing the charge. The amphipathic substances according to the published German Patent Application 2,114,773 are rather fairly complicatedly constructed trifunctional contact systems the manufacture of which is accordingly complex.

It is the object of the invention to provide a dispersion for applying solid particles on surfaces by an electrophotographic method, which dispersion has a composition which is as simple as possible.

According to the invention this is achieved with a dispersion of the kind mentioned in the preamble which is characterized in that it comprises, as the only substance controlling the charge, an aluminum (III) salt or a chromium (III) salt of the formula $Al(AN)_n(OH)_{3-n}$ or $Cr(AN)_n(OH)_{3-n}$, where $n = 1,2$ or 3 and preferably $n = 1$ or 2 and AN is the acid residue of an anthranilic acid possibly substituted at the benzene nucleus and of which the amino group is acylated with a fatty acid containing 6 to 20 carbon atoms.

The statement of an exact structural formula may not be considered to be limiting. It is known that such and similar compounds form associates with a different number of monomers to which, if desired, water may also be added. Hence it is very well possible that said compounds are present in the dispersion in a form which does not exactly correspond to either of the above-stated stoichiometric formulae. Said formulae should only be considered as rough ratio numbers.

As substituents at the benzene nucleus are to be considered: halogen-, aryl-, alkyl-, aralkyl-, nitro-groups, further amino-, o-alkyl-, o-aryl, o-aralkyl-, hydroxyl- and/or ester groups.

Very favourable results are obtained when the amino group of the anthranilic acid is acylated with a stearyl group. Very favourable results can also be obtained with a lauroyl group as a substituent. Generally speaking the substituent should be chosen to be so that the corresponding aluminum (III) salts or chromium (III) salts are soluble in non-polar media.

The aluminum (III) salts or chromium (III) salts are preferably added to the dispersion according to the invention in quantities of $10^{-3}$ to $10^{-1}$ g calculated on 100 g of solid.

Chromium (III) salts of aminobenzoic acids possibly substituted at the nucleus by low-molecular alkyl-, halogen, nitro- and/or hydroxyl groups, in particular the anthranilic acid the amino group of which is acylated with a fatty acid containing 13 to 19 carbon atoms, are known per se from the published German Application 2,116,556 in which the use of such chromium (III) salts is described for rendering hydrocarbons antistatic. In the examples of said Application, however, are described only the tri-stearylanthranilate and the tri-oleylanthranilate of the chromium.

As already stated in the preamble, the dispersion according to the invention comprises non-ionogenic macromolecular compounds. Said addition is necessary as a rule to fix the deposited particles. In exceptional cases, for example, when either the solid particles have a stronger cohesive power already on the basis of their chemical structure, or when the fixing following the development is carried out in a separate step, it is possible to omit the non-ionic macromolecular compounds.

With a suitable choice of the non-ionic macromolecular compounds, for example, with respect to their quantity of polar and non-polar groups, the electric properties of the dispersion can moreover be influenced favourably. As non-ionic macromolecular compounds there are used, for example, polymethacrylic acid esters, polyacrylic acid esters, polyalkylstyrenes, polyvinylalkyl ethers as well as copolymers from methacrylates with cyclic amides and amines, respectively, with vinyl pyridines and styrene, as well as copolymers from butadiene and styrene. In these compounds, the carbon number of the aliphatic groups and the ratio between the monomers (with butadiene-styrene), respectively, should be chosen and adjusted, respectively, with a view to the solubility. For example, polymethacrylates the ester components of which contain between 6 and 20 carbon atoms are very suitable. The molecular weight of these compounds may be between 100,000 and 1,500,000. Furthermore there is recommended the copolymers of vinylpyridines with methacrylates, the ester components of which contain between 6 and 20 carbon atoms. Used in particular are polymethacrylic acid lauryl-stearyl esters, for example, esters which are marketed by Röhm G.m.b.H. as "Viscoplex SV 31", or copolymers of 4-vinylpyridine with lauryl- and stearylmethacrylate.

With the charge-controlling compounds proposed according to the invention, simple dispersions of particles can be prepared with which a very good particle separation is obtained.

Larger particles can also be readily separated by only one of these change-controlling compounds. This follows from the fact that the aluminum (III) salts or chromium (III) salts used according to the invention by itself produces a high charge on the solid particles, while the additions usually employed to charge the solid particles produce said high charge only in combination with further ionic or polymeric additions.

The great advantage of the invention is that with the said charge-controlling compounds, dispersions can be prepared which enable in a simple manner recycling of the dispersion used. Upon recycling, the dispersion can be given the desired composition again by the addition of only three substances, namely pigment, charge-controlling compound and macromolecular compound.

A further advantage is that a sufficiently high electric charge is obtained also with comparatively large particles as they are used, for example, in the electrophoretic production of the black matrix in the colour display tube. This gives rise to an electrophoretic behaviour of the suspensions (see example 2).

The invention is used particularly advantageously in combination with phenazine dye stuffs and pigments having a wide grain size spectrum for example Echtschwarz 303 T, an inorganic black pigment on the basis of iron oxide, marketed by Bayer A.G., and flame soot types.

The invention will now be described in greater detail with reference to a few examples.

EXAMPLE 1

The N-acylanthranilic acids used were prepared by reacting equimolar quantities of anthranilic acid and acylchloride in pyridine. After a short thermal treatment the reaction mixture was cooled and brought in icy water. The resulting precipitate was caught, washed with water and recrystallized from acetonitrile.

The chromium (III)-N-acylanthranilates were prepared in a methanol solution of N-acylanthranilic acid and $Cr(NO_3)_3.9H_2O$ in the desired ratios while adding $CH_3ONa$ dissolved in methanol. The resulting precipitate was separated from the methanol by pouring off, washed several times with methanol and again dissolved in toluene or chloroform or tetrahydrofuran. The solution was filtered and evaporated to dryness. The composition was fixed by the determination of the chromium content.

For the preparation of the dispersions it is efficacious to prepare starting solutions with a given concentration. As solvents may be used, for example: toluene, xylene, benzene, ethanol, propanol, butanol, and other alcohols, dimethylformamide, dimethylsulfoxide, pyridine, acetonitrile, chloroform and other halogenated hydrocarbons. The solvents may also contain small quantities of water.

The quantities of the various components in the liquid dispersions may vary within wide limits. The said quantities therefore are given only by way of example and any person skilled in the art can simply determine the optimum quantities for a given application.

EXAMPLE 2

1 g of soot Printex 30 (Degussa), 9 g of Helioechtschwarz (aniline black (Bayer)), $2 \times 10^{-4}$ g of $Cr(AN\text{-}17)(OH)_2$ (AN-17 = acid residue of the N-stearoylanthranilic acid), 10 g of Plexisol D 592 (low-viscous polybutylacrylate having a low molecular weight in light benzine of Röhm G.m.b.H., Darmstadt) and 40 g of Sangajol (test petrol of the Deutsche Shell Chemie) are ground in a ball mill for 16 hours. The concentrate is diluted dropwise to 1000 g with a mixture of Sangajol and Shellsol T (pure aliphatic hydrocarbons of the Deutsche Shell Chemie) in the ratio 1:3. The mass of concentrate which is diluted directs itself to the desired pigment concentration. A stable, charged soot developer is obtained which was tested in a professional copying machine. The resulting copy has little background. The fixation and the contrast are good.

EXAMPLE 3

1 g of Echtschwarz 303 T (Bayer), $2.10^{-4}$ g of $Cr(AN\text{-}17)(OH)_2$ and 0.15 g of 4-vinylpyridine-lauryl-stearyl-methacrylate copolymer are dispersed in 300 ml of Shellsol TD by means of an ultrasonic treatment. A very uniform electrophoretic deposition is obtained with these dispersions in spite of a large particle size. This stable, charged black developer, may be used, for example, for the manufacture of TV matrices.

EXAMPLE 4

1 mol of nigrosinebase TD(BASF) is acylated with 1 mol of acryloylchloride. 6 g of the reaction product is ground in a ball mill for 16 hours with $5.10^{-3}$ g of $Cr(AN\text{-}17)\ (OH)_2$, 3 g of auxiliary substance 5669 (solution of a nitrogen-containing polymethacrylate in mineral oil of Röhm G.m.b.H.) and 30 g of Sangajol. For the dilution and test see Example 2.

A few examples according to the invention for phosphorus dispersions will be given hereinafter. Such dispersions are suitable for the manufacture of colour display tubes as described in greater detail in the preamble.

EXAMPLE 5

1.5 g of activated ZnCdS (a green luminescent substance) $2.10^{-4}$ g of $Cr(AN\text{-}17)_2OH(AN\text{-}17)$ = acid residue of the N-stearoylanthranilic acid), 0.075 g of 4-vinyl-pyridine-lauryl-stearylmethacrylate copolymer and 300 ml of Shellsol TD are ground in a ball mill for 30 minutes. A very good deposition of luminescent material is obtained.

EXAMPLE 6

1.5 g of activated ZnCdS (see example 5), 0.075 g of copolymer (see example 5), $2.10^{-4}$ g of $Cr(AN\text{-}11)_2OH$ (AN-11 = acid residue of the N-lauryl-anthranilic acid), 300 ml of Shellsol TD. After an ultrasonic treatment of a few minutes, lines of luminescent material may be deposited with these dispersions electrophorectically.

EXAMPLE 7

1.5 g of activated ZnCdS (see example 5), 0.075 g of copolymer (see example 5), $2.10^{-4}$ g of $Al(AN\text{-}17)_3$ (AN-17: see example 2) and 300 ml of Shellsol TD are dispersed by means of an ultrasonic treatment. Lines of luminescent material may be deposited with these suspensions electrophorectically.

What is claimed is:

1. A dispersion for applying solid particles on a surface by an electrophotographic process, said dispersion comprising, in addition to the solid particles to be applied to the surface, a non-polar liquid dispersing agent for said solid particles, a non-ionic macromolecular compound of a molecular weight of 100,000 – 1,500,000, soluble in said liquid dispersing agent and as the sole substance for controlling the charge on said solid particles a metal salt selected from the group consisting of salts of the formulae:

$$Al(AN)_n(OH)_{3-n}$$

and $$Cr(AN)_n(OH)_{3-n}$$

wherein $n = 1, 2$, or 3 and AN is the acid residue of an anthranilic acid, the amino group of which is acylated with a fatty acid of 6 to 20 carbon atoms, said metal salt being soluble in the dispersing agent and being present in an amount of $10^{-3}$ to $10^{-1}$g per 100 g of said solid particles.

2. A dispersion as claimed in claim 1, wherein in the formulae $n = 1$ or 2.

3. The dispersion of claim 1 wherein the nucleus of the acylated anthranilic acid is substituted with at least a moiety selected from the group consisting of halogen, aryl, alkyl, aralkyl, nitro, amino, O-alkyl, O-aryl, O-aralkyl, hydroxyl and ester.

4. The dispersion of claim 1 wherein the amino group of the anthranilic acid is acylated with stearyl.

5. The dispersion of claim 1 wherein the amino group of the anthranilic acid is acylated with lauryl.

6. The dispersion of claim 1 wherein the amino group of the anthranilic acid is acylated with oleyl.

7. The dispersion of claim 1 wherein the non-ionic macromolecular compound is a polymethacrylate, the ester components of which are of 6–20 carbon atoms.

8. The dispersion of claim 1 wherein the non-ionic macro-molecular compound is a copolymer of vinyl pyridine with a methacrylate the ester components of which are of 6–20 carbon atoms.

9. The dispersion of claim 1 wherein the solid particles are luminescent substances suitable for use in color television display tubes.

* * * * *